US005557835A

United States Patent [19]

Brandts

[11] Patent Number: 5,557,835

[45] Date of Patent: Sep. 24, 1996

[54] METHOD, RIVET-PUNCH, FOR JOINING SEVERAL METAL SHEETS BY USING NON-HEAT-TREATED RIVETS MADE FROM AN ALUMINIUM ALLOY

[76] Inventor: Michiel P. Brandts, Godelindeweg 5, NL-1217 HP Hilversum, Netherlands

[21] Appl. No.: 107,705

[22] PCT Filed: Feb. 18, 1992

[86] PCT No.: PCT/NL92/00034

§ 371 Date: Oct. 12, 1993

§ 102(e) Date: Oct. 12, 1993

[87] PCT Pub. No.: WO92/14566

PCT Pub. Date: Sep. 3, 1992

[30] Foreign Application Priority Data

Feb. 19, 1991 [NL] Netherlands ..... 9100286

[51] Int. Cl.[6] ..... B21J 15/02

[52] U.S. Cl. ..... 29/524.1; 29/243.54; 72/476

[58] Field of Search ..... 29/524.1, 525.2, 29/243.54, 243.53; 72/477, 479, 476

[56] References Cited

U.S. PATENT DOCUMENTS

| | | | |
|---|---|---|---|
| 3,426,641 | 2/1969 | Rosman . | |
| 3,561,102 | 2/1971 | Diemer | 29/524.1 |
| 3,908,257 | 9/1975 | Briles . | |
| 3,952,401 | 4/1976 | Wagner | 29/524.1 |
| 4,630,463 | 12/1986 | Knowlton | 72/476 |
| 4,864,713 | 9/1989 | Roberts et al. | 29/243.54 |
| 5,060,362 | 10/1991 | Birke et al. | 29/525.2 |

FOREIGN PATENT DOCUMENTS 2513932 10/1975 Germany .

OTHER PUBLICATIONS

P. G. Reinhall et al. "An Analysis of Rivet Die Design in Electromagnetic Riveting", *Journal of Vibration, Acoustics, Stress, and Reliability in Design*, pp. 65–69, vol. 110, Seattle, Washington, Jan. 1988.

*Primary Examiner*—David Jones
*Attorney, Agent, or Firm*—Young & Thompson

[57] ABSTRACT

The invention concerns a method for riveting a packet (50) of sheets (51,52) by means of unannealed aluminum rivets made from an alloy harder than that of the relatively soft AD rivets in common use; this method is characterized by the fact that the expansion of the head to be formed at the shank end (58,59) of the rivet during the riveting process is controlled by a snap-tool (62) which encloses the shank end (58,59) at first loosely. When the expansion of the head diameter approaches D=1,5 d (with d the rivet diameter), i.e., the limit above which cracks form in the head, the tool (62) prevents further deformation and forces the material of the head to deflect towards the central portion of the rivet shank (57) which subsequently expands and widens the hole (53) sufficiently to make the riveted joint last considerably longer. The good loosely and, later in the process, tightly fitted enclosing of the shank end (58,59) by the snap-tool (62) allows the riveting to be done manually. This can still be improved further by using a snap-tool (62) with a profile (67, 68, 69) complementary to the contour of the shank end (58, 59).

11 Claims, 9 Drawing Sheets

Figure 1:
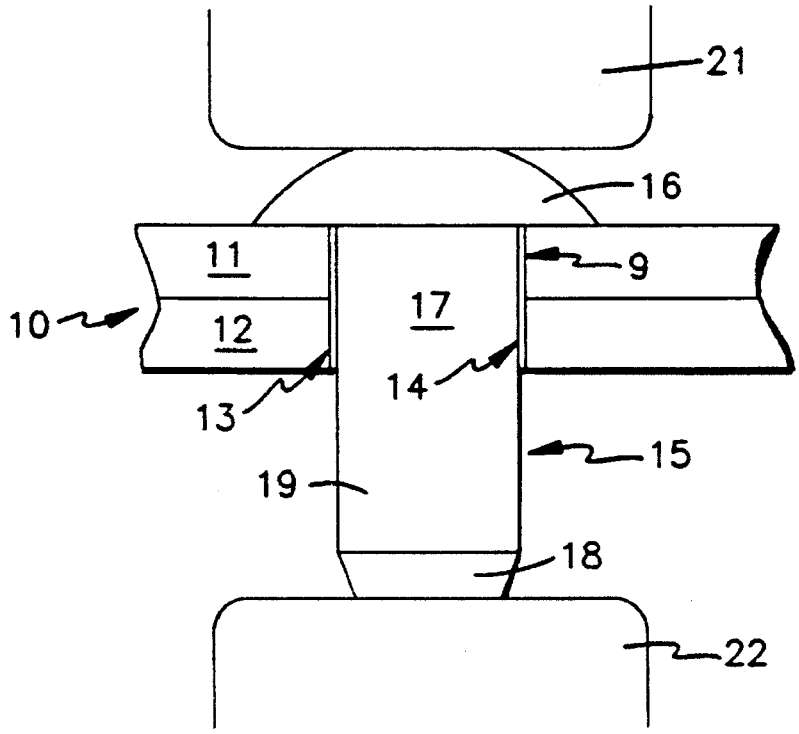
Figure 2:
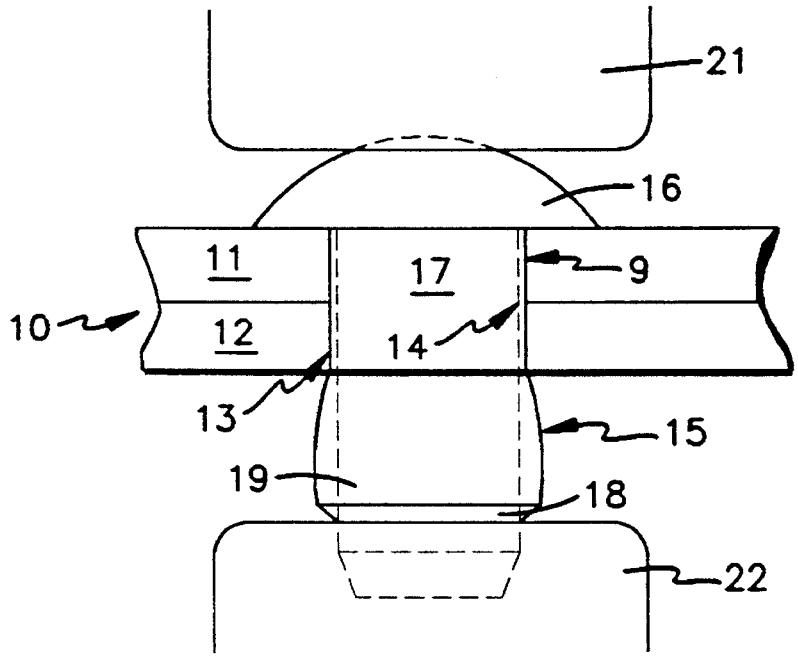
Figure 3:
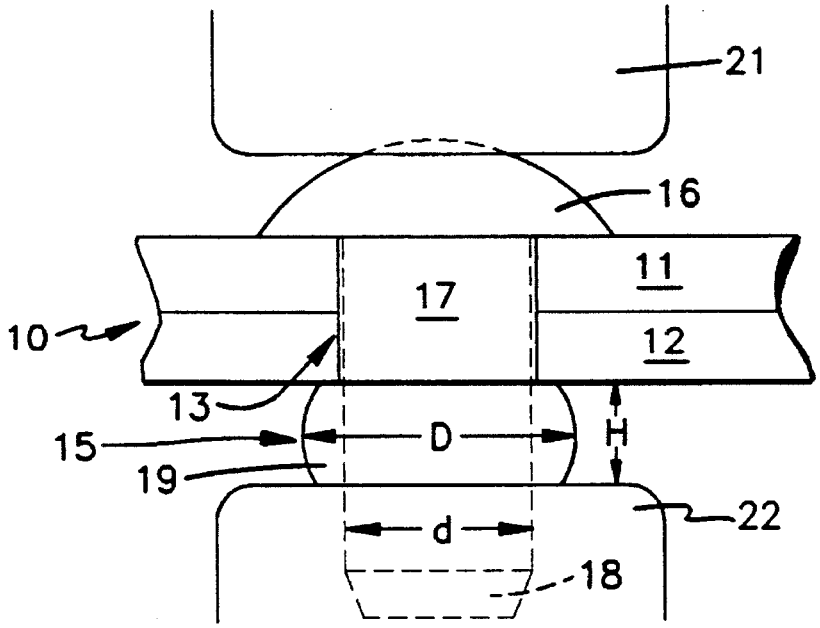
Figure 4:
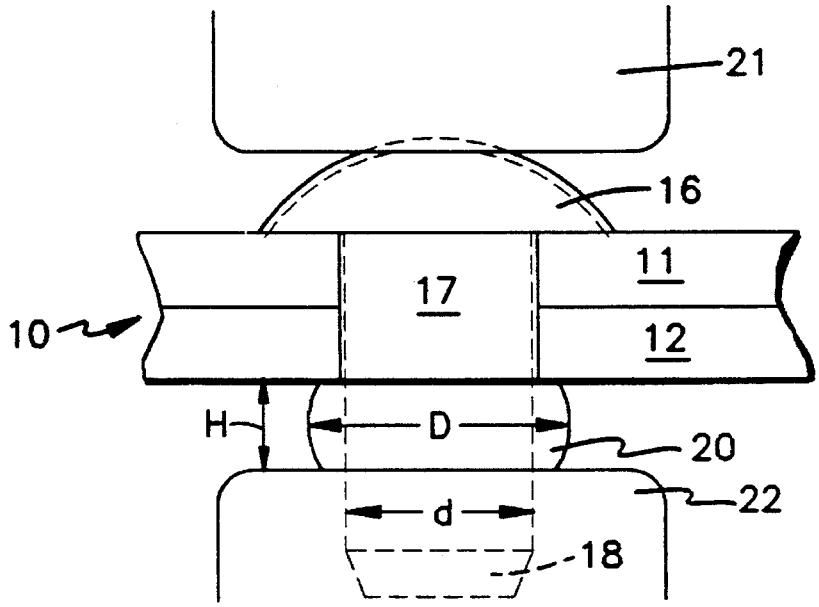
Figure 5:
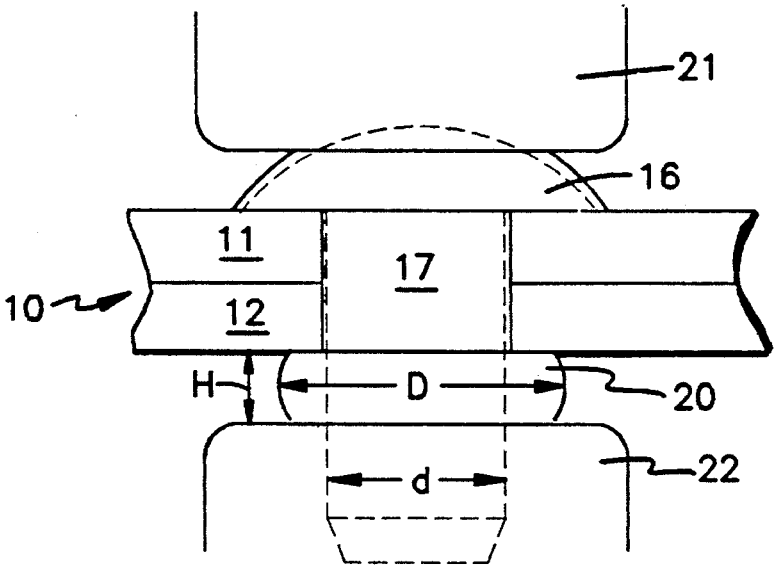

METHOD, RIVET-PUNCH, FOR JOINING SEVERAL METAL SHEETS BY USING NON-HEAT-TREATED RIVETS MADE FROM AN ALUMINIUM ALLOY

SPECIFICATION

1. Introduction

This invention relates to a method of joining several metal sheets by using non-heat-treated rivets made from an aluminium alloy, if any provided with a rivet head, in which rivet punches—being used for forming the riveted head and, if any the rivet head—surround the shank end in question, whereas the two rivet-punches exert on the rivet shank such forces that one (riveted) head or, if any, two heads are formed, without the occurrence of cracks in the head, while at the same time sufficient widening out of the hole takes place. Such a method is known from an Article written by T. H. Speller & J. A. Randolph, which is a reprint from "Aircraft Engineering" (February 1972), issued by General-Electro Mechanical Corp., dealing with AD-rivets.

In the aircraft industry the use of fasteners, like bolts, rivets and blind rivets is wide-spread. These fasteners join parts (metal sheets) and transmit the forces exerted theron. The great majority of fasteners are machine-riveted or hand-riveted joints.

Rivets made from high strength aluminium alloys such as 2017, 2017A and 2024, have to undergo before being applied first a solution heat-treatment to obtain the required deformability. Thereafter they are quenched and stored in a freezing box or similar cold storage space.

This heat treatment has disadvantages, mainly in the field of logistics: additional handling and checking thereof, controlling of the durability of the rivets. That is, the rivets have to be riveted within a restricted time period after the solution heat-treatment. After elapse of said time period, the non-processed remainder of the batch of solution heat-treated rivets, taken from the freezing box at the beginning of said time period, have to go to scrap. This is because from that moment they are unfit for further processing, involving much loss of labour and material.

Reduction of the use of said solution heat-treated rivets would considerably improve the riveting process from a logistics point of view and substantially reduce the costs involved.

2. The Actual Riveting Method

A modern aircraft consists of several thousands of sheet metal components. These components are usually joined by means of rivets. Before a rivet can be installed, the sheets to be joined have to be positioned. Where a rivet is required, a hole is drilled and, if necessary, counter-sunk. After de-burring, the rivet is placed loosely into the hole.

During riveting the rivet is loaded in axial direction, depending on the riveting method, either by an intermittent or a continuous force (gun or press) such that the shank piece projecting through the sheet-stack is deformed. This is the so-called "riveted head" or upsetting. The diameter of the riveted head depends on the riveting force. The higher the riveting force, the greater the diameter of the riveted head.

The dimensions of the riveted head must comply with specifications from rivet and aircraft manufacturers. This means that D must be between 1,25 d and 1,67 d and H must be between 0,33 d and 0,67 d The nominal sizes are $D_{nom}$=1,5 d $H_{nom}$=0,5 d A large diameter of the riveted head improves the clamping-on of the sheet-stack. This is favourable for the life-time of the riveted joint. The extent to which the rivet-shank fills the hole, also depends on the riveting force. The higher the riveting force, the better the hole-filling. With sufficient riveting force even "widening out of the hole" may occur as consequence of shank (or slug) expansion of the rivet. Widening out of the hole extends the lifetime of a riveted joint considerably. Since the diameter of the riveted head is easily measurable at any time—as opposed to the riveting force—the diameter of the riveted head is seen as the quality defining parameter.

In the art of aircraft-construction the following alloys are mainly used:

| | | | | deformability | |
|---|---|---|---|---|---|
| alloy | | code | shear-strength N/mm$^2$ | mild | hard |
| 2117 | T3 | AD | 207 | | 1,7–1,8d |
| 2017 | T31 | D | 234 | 1,8–1,9d | 1,4–1,5d |
| 2017A | T31 | S | 255 | 1,8–1,9d | 1,4–1,5d |
| 2024 | T31 | DD | 282 | 1,8–1,9d | 1,4–1,5d |
| 7050 | T73 | KE | 296 | | 1,5–1,6d |

To obtain the required deformability the D-, S- and DD-rivets first have to undergo a heat-treatment; comprising:

solution-heat-treatment (for 30 minutes at 500° C.)

quenching in cold water storage, until use, in a freezing box at −20° C.

After withdrawal from the freezing box the D and S rivets (slugs) must be riveted within 2 hours; DD rivets must be riveted within 20 minutes. The whole process around the heat-treatment requires quite some logistics effort.

In automatic drilling/riveting machines (ABK's) the solution heat-treated rivets cause much more jamming of the equipment, involving additional time and possibly leading to product-rejection. Rivets which are not riveted within the prescribed period, are thrown away. Owing to the very short processability time of DD-rivets, they are no longer used.

It would be of great advantage, if the solution-heat treatment would not be required. However the application of non-heat-treated rivets is subject to restrictions, in view of the great forces, which are necessary for deforming the cylindrical rivet shank-end to a riveted head of greater diameter, said forces mostly leading to crack-formation in the riveted head. Experiments have confirmed these expectations. The findings are as follows:

AD-rivets

These are non-heat-treated rivets which—with a shear strength of 207 N/mm$^2$—are relatively weak, but sufficiently ductile to be easily cold-deformable without heat-treatment.

D-, S-, DD-rivets

If D or S or DD-rivets are riveted when non-heat-treated, there will occur an inadmissible crack-formation at an expansion of the riveted head of more than 1,4 to 1,5 d. The riveting force, necessary for the formation of riveted heads of 1,4 d is not high enough for a good widening out of the hole. The lifetime of the riveted joint is, in this case, considerably lower.

KE-rivets

They are applied, non-heat-treated; due to their relatively high shear stress, they are harder than AD-material, such that great forces are necessary for the cold-deformation during the riveting process. Therefore they do not allow—due to crack formation—larger riveted heads than 1,5 to 1,6 d; thus no good widening out of the hole can occur. Here, too, the life-time is lower than that of solution heat-treated D or S rivets. Moreover KE rivets are considered to be susceptible to stress-corrosion. This type of rivets is the subject of an article written by Reinhall, Ghassaei and Choo in "Journal of Vibration, Acoustics, Stress and Reliability in Design" volume 110, nr 1, 1988, pp. 65–69.

3. The Novel Riveting Method

The object of the invention is to eliminate these objections in providing a method of yielding—with non-heat-treated D & S rivets—a joint being stronger and having a longer life-time than joints with non-heat-treated AD rivets or with heat-treated D or S rivets. Moreover the process is more economic.

The method according to the invention is characterized in that for the aluminum-alloy use is made of material with a minimum shear-strength of 230 N/mm$^2$. This alloy obtains in the hardened state a high strength due to precipitation hardening, whereas the rivet-punch surrounds the shank-end thus broadly that the expansion of the head to be formed from said shank-end as a consequence of cold deformation remains within the limit, above which crack-formation can occur.

The process is based upon the fact that the riveted head is not formed by a flat punch but by a punch which surrounds the riveted head such that while working with greater riveting forces, the expansion of the riveted head is restricted to a value excluding the formation of cracks in the riveted head.

Thus high riveting forces and therefore a good widening out of the hole are possible, resulting in a longer life-time, as has been demonstrated with comparative experiments.

Due to the cold-deformation of the rivet shank, the static strength increases by 15 to 20% with respect to heat-treated rivets, and by 40 to 50% with respect to rivets which in accordance with the conventional method do not need a solution heat-treatment, such as AD rivets. The protruding length should be taken between 1,0 d and 1,25 d, which in view of the many hundreds of thousands of rivets per aircraft yields a saving in weight of many kg's. The dimensions of the riveted head satisfy the specifications mentioned in section §2.

Advantages solution heat-treatment not necessary;
cold storage not necessary;
unlimited processability time;
more economical use of rivets (due to less 'scrap' of rivets);
greater static strength;
longer life-times;
shorter time of passage because an important source of disturbances of automatic drilling-riveting machines (ABK's) can be eliminated;
the product documentation need not be modified;
saving in weight;
repair of damage can be done in places having no solution heat-treatment facilities;
less product-rejection due to a better controllable riveting process.

The known method, described in the article mentioned in the introduction, deals with the riveting of aluminium AD-rivets.

The material is mild, so the riveted joint, obtained therewith, is not strong. The rivet-punch applied in the known method, does not give a good enclosing around the shank-end; this does not pose any difficulty for this relatively mild material: The diameter of the riveted head can be expanded to D=1,8 d without cracks, so that a good widening out of the hole can be obtained.

In modern aircrafts the sheet metal assembly of fuselage and wings is exposed to higher forces, due to the higher speeds, accelerations and decelerations. This asks for stronger riveted joints, for which AD-material is inappropriate.

In order to obtain strong riveted joints the inventor has fixed—as mentioned in the characteristic clause of claim 1—on aluminium-alloys having a shear strength of at least 230 N/mm$^2$, and a good enclosing of the shank-end by the rivet punch to keep the cold-deformation of the head to be formed, within certain limits.

In the method according to the invention the shape of the rivet-punch can still further be improved in that the broadly surrounding rivet punch is provided with a profile, the central part of which having a shape being complementary to that of the shank-end, so that the rivet punch obtains a self-centring function.

This self-centring function of the rivet punch does not exist in the known method (of Speller & Randolph). There, the profiling of the rivet punch takes the shape of small cups, with which self-centring is impossible. Therefore the known method is not appropriate to manual operation, but exclusively suited to fully automatic operation. This is a disadvantage; for, most riveting activities on an aircraft have to be done manually.

Preferably the method according to the invention is executed such that as the aluminium alloy use is made of an alloy from the Alcoa 2000 series having the denominations 2017, 2017A or 2024.

Another possibility to benefit from the method according to the invention is that in which for the aluminium alloy use is made of an alloy from the Alcoa 7000 series with a minimum shear strength of 280 N/mm$^2$.

Preferably the present invention is herewith conducted such that for the aluminium alloy is used an alloy with the denomination 7050.

The invention is further concerned with a rivet produced from the alloy-material to be used in the present method as well as with a rivet, riveted by the present method.

Further the invention concerns a rivet punch to be used in the present method, characterised by a stepped contour of the profile, provided with a central part, having a shape being complementary to that of the shank-end to be cold-deformed, of the rivet to be riveted.

Moreover the protection, given by the invention, extends also to the riveted joint, obtained by the application of the present method or of the present rivets in combination with one or two rivet punches.

Figure 8:
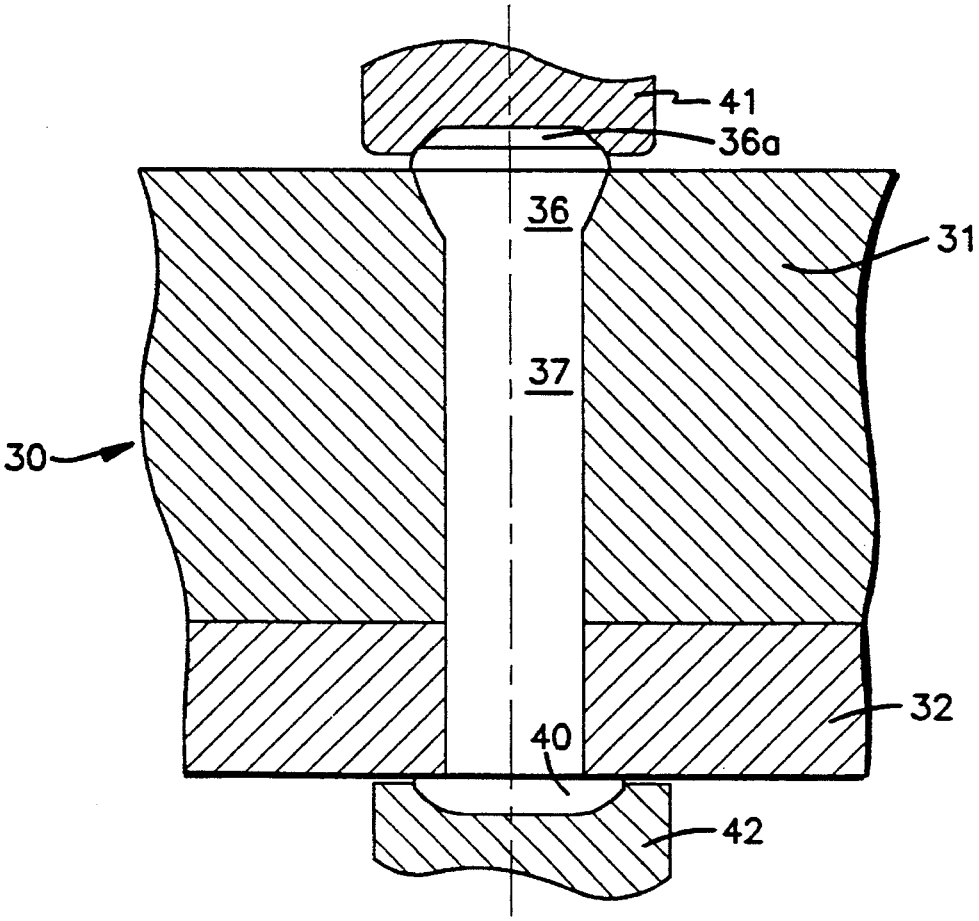
Figure 6:
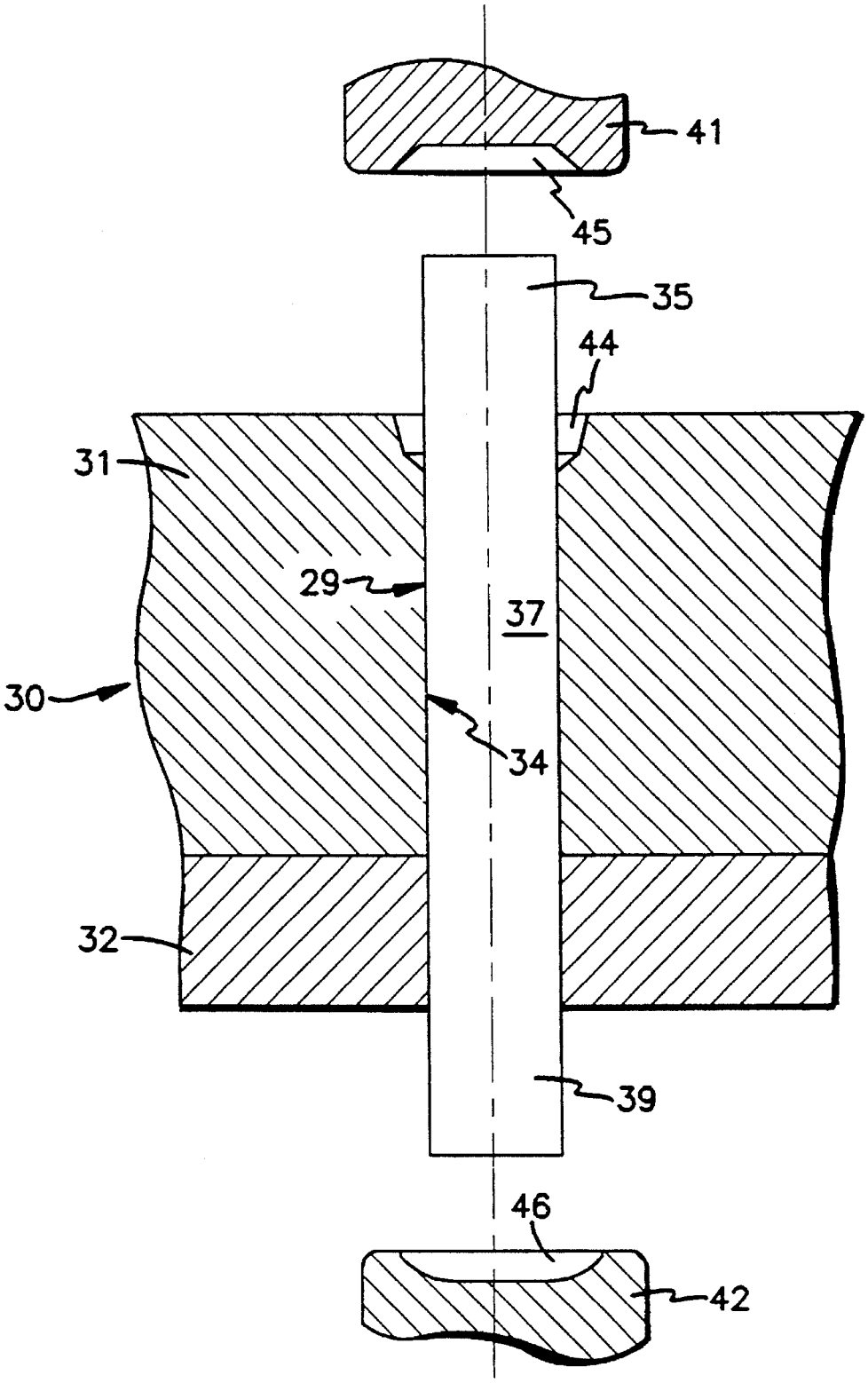
Figure 7:
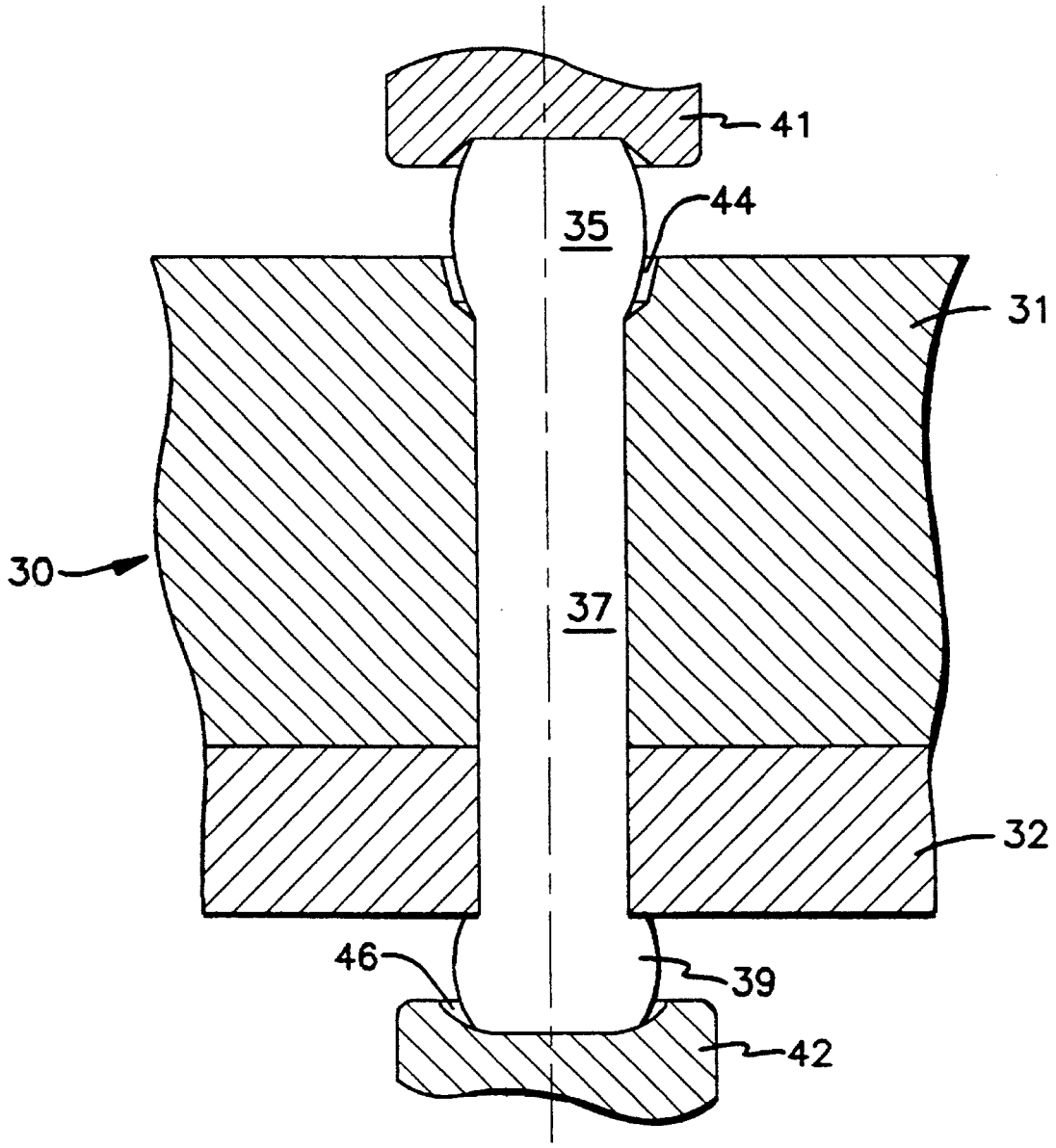

The invention will be explained herebelow whilst referring to the figures of the attached drawings, in which FIGS. 1 to 5 show various phases of the conventional method with non-heat-treated rivets of relatively mild material (e.g. AD-rivets) or with solution heat-treated rivets of relatively hard material (e.g. D-, S-, DD-rivets);

FIGS. 6 to 8 show different phases of the known Speller & Randolph method with non-heat-treated rivets (e.g. AD-rivets); and FIGS. 9 to 18 show various phases of the method according to the invention with non-heat-treated rivets (e.g. D-, S-, DD- or KE-rivets).

FIG. 1 successively depicts the plate-stack 10 to be joined, consisting of two (or more) plates or sheets 11 and 12, with a hole 13, being drilled therein, after the sheets 11 and 12 have been clamped together in preparation of the riveting treatment. In the hole 13 is put a rivet 15 provided with a rivet-head 16 and a shank 17 having on its free extremity a pilot edge 18, if any. When the rivet 15 is placed into the hole 13, part 19 of the shank 17 protrudes through the plate-stack 10. From this part 19 the riveted head 20 has eventually to be formed during the riveting process. The rivet is an AD-rivet, not very strong, having a shear-strength of 207 N/mm$^2$.

To perform the riveting process proper, the rivet is placed between two rivet punches (or cup-tools): an upper rivet punch 21 and a lower rivet punch 22. In the conventional method use is made of flat punches, as shown in FIGS. 1–5. Between such punches there cannot be question of self-centring.

Despite this, manual operation is possible. This is, because the non-heat-treated (AD) material is rather easily cold-deformable (rather mild). Due to this easy deformation a good riveted head is formed; expansion till 1,8 d without crack-formation is possible. At the same time a good widening out of the hole is obtained, resulting in a long life-time.

The only objection is that the rivet joint obtained with these (AD) rivets is not very strong.

In FIGS. 6–8 three phases of the known method of Speller & Randolph are shown. The rivets used in this method are non-heat-treated and of relatively mild material, as e.g. AD-rivets. Insofar there is similarity with the conventional method, as explained with reference to FIGS. 1–5. The difference is that Speller & Randolph do not make use of flat punches, but of cup-shaped punches. However the profile used by them is not suited for self-centring, so that the riveting process can only be performed in fully automatic operation. This is a disadvantage, because—as said—the fully automatic operation covers only a minor part of the total riveting work.

The authors of the known method evidently do not consider this as a disadvantage, for they just strive to substitute the tools of the manual operation for riveting machines developed for automatic production, in which the machine-actions must be repeatable. The following explanation refers to FIGS. 6–8.

In FIG. 6 is shown a plate-stack 30 consisting of plates or sheets 31 and 32, in which a hole is drilled, bounded by the hole wall 29, said hole showing at its top a recess or countersink 44. Into the hole is stuck a rivet shank 37, whose circumference 34 is in engagement with the hole wall 29. The shank 37 projects through the plate-stack 30 above and below. This gives a shank-end 35 at the upper side and a shank-end 39 at the lower side, from which during the riveting process the heads 36 and 40 resp. (FIG. 8) are formed. To this end use is made of an upper and lower rivet punch 41 and 42 resp., which contain a recess 45 and 46 resp.. It will, however, be clear that the cup-shaped profile 46 of the rivet punch 42 is not able to centre the shank-end 39 to a sufficient extent so that manual operation is extremely difficult here, and one depends exclusively on fully automatic operation.

In FIG. 7 the two slug (shank)-ends 35 and 39 have already undergone a certain expansion. In the recess 44 is formed—during this riveting process—a counter-sunk riveted head 36; the part 36*a* projecting beyond the stack is automatically milled off after the riveting process.

In FIG. 8 the riveting process is finished, and an upper head 36 and a lower head 40 resp. has been formed from the shank-ends 35 and 39.

Figure 9:
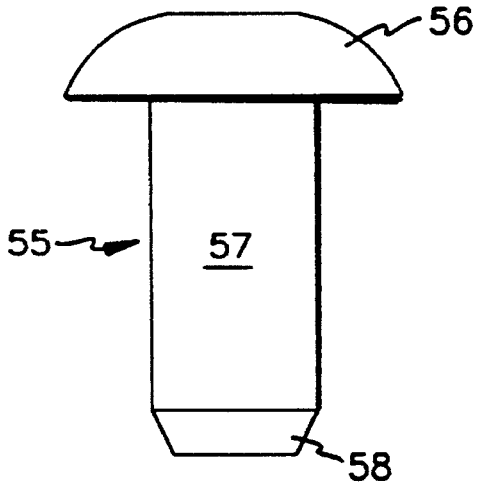
Figure 15:
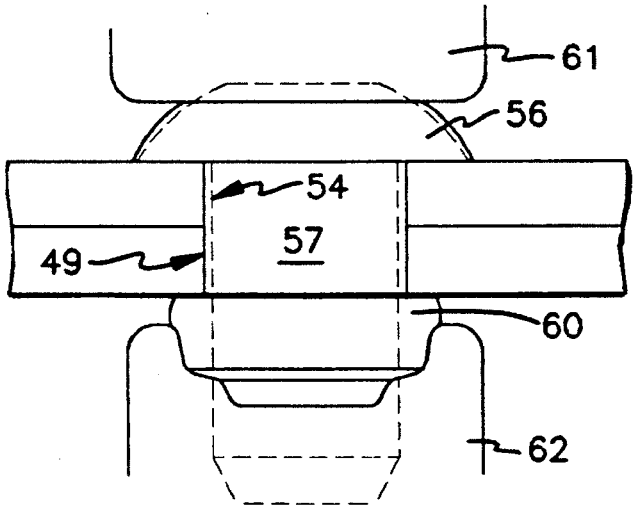
Figure 16:
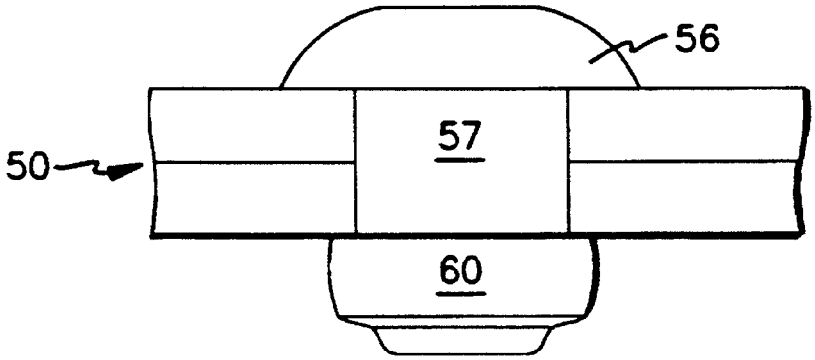
Figure 17:
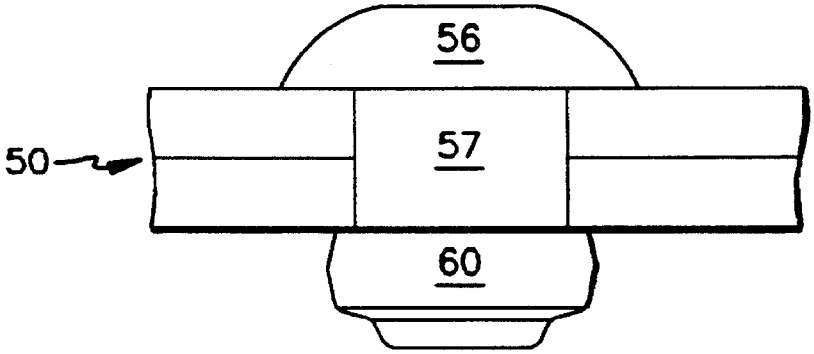
Figure 18:
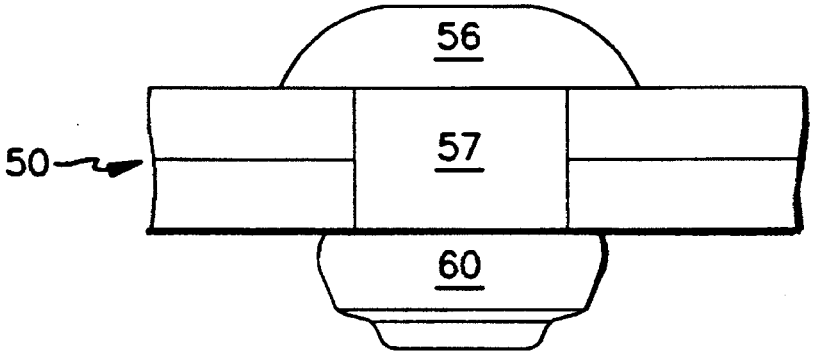

FIGS. 10–18 serve as illustration of the method according to the invention in which a rivet of the D-, S-, DD- or KE-type is used, separately illustrated in FIG. 9. These are alloys, which have obtained, by precipitation-hardening, a high (shear) strength: more than 230 N/mm$^2$. FIGS. 16–18 show the riveting joint of FIGS. 13–15, but now without rivet punches 61,62.

An important difference from the conventional and the known method resp., shown in FIGS. 1–5 and FIGS. 6–8 resp., is that here the lower die 62 is profiled such that the lower-end of the shank 57—with or without centring edge 58—is surrounded by the profiling of the punch thus broadly that the expansion of the shank-end 59 during the riveting process remains within the limit, above which crack formation can occur.

The method is best employed by using a punch having in the central part a profile being complementary to that of the shank-end, possibly provided with a centring edge 58 (38, 18), such that the punch is self-centring.

Figure 10:
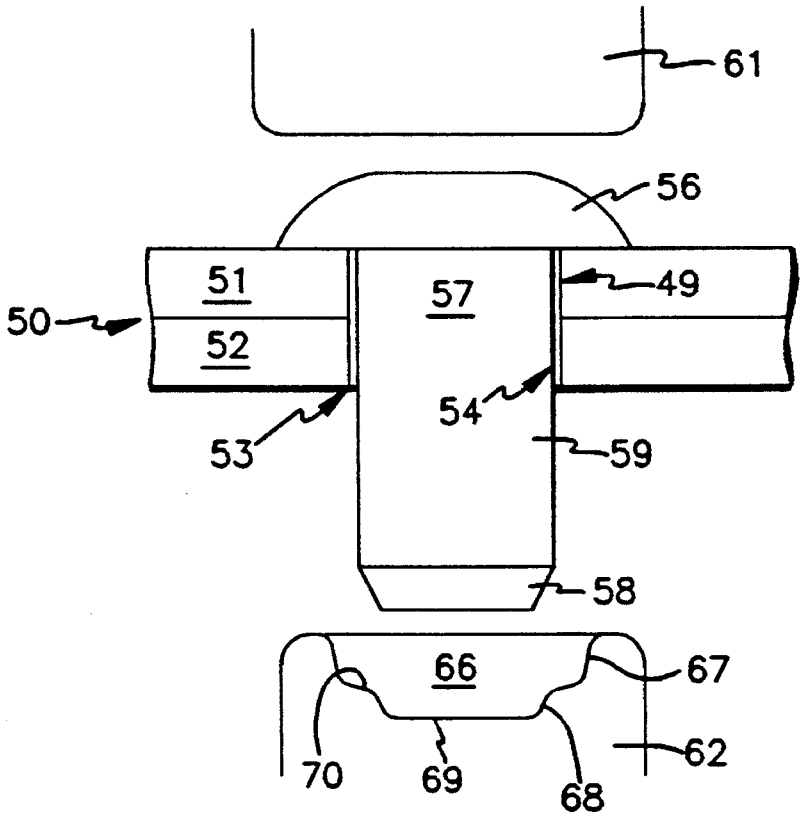
Figure 11:
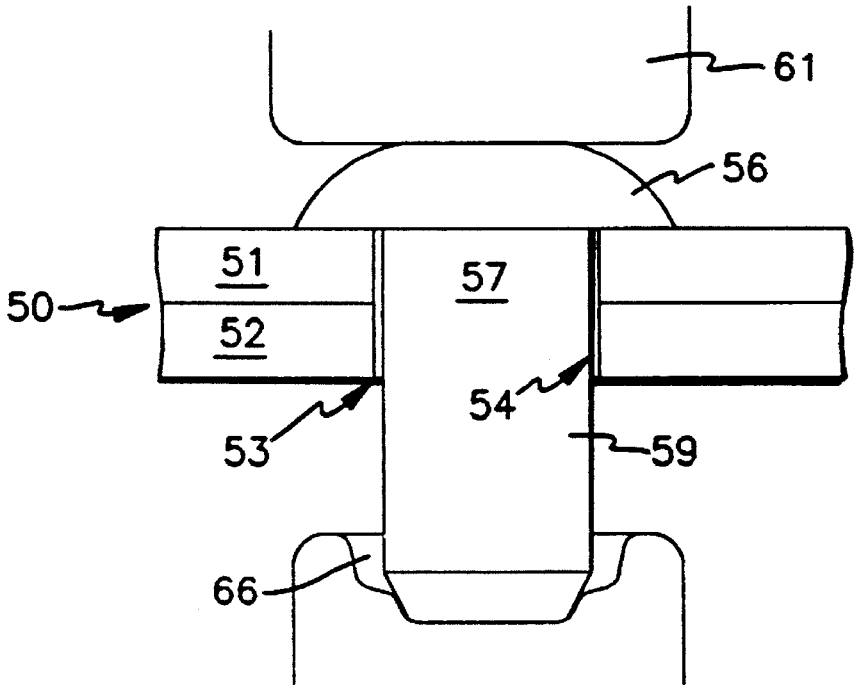
Figure 12:
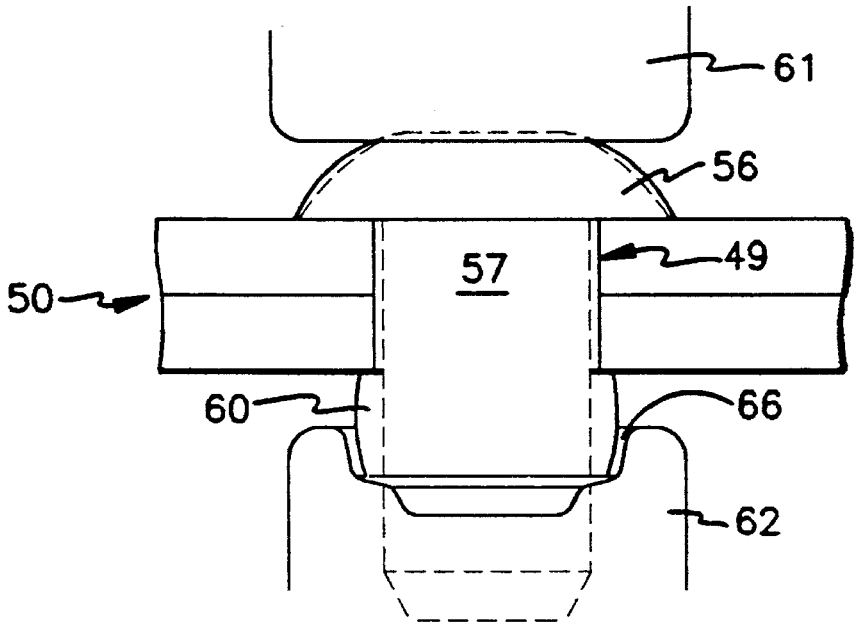
Figure 13:
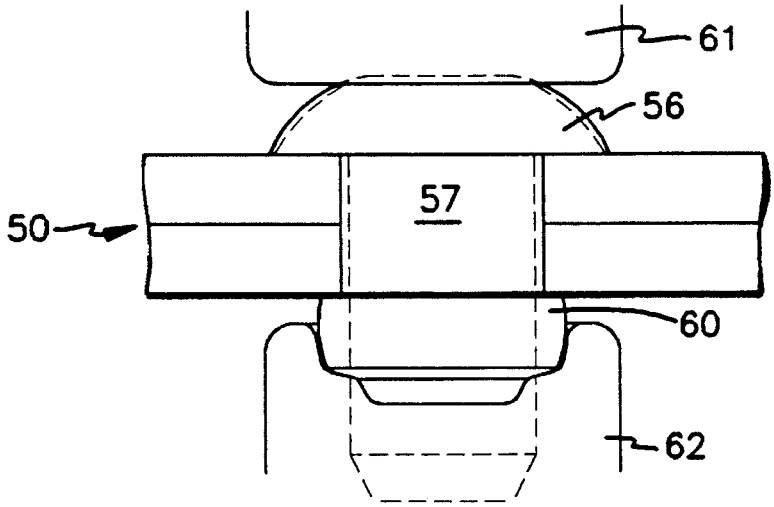
Figure 14:
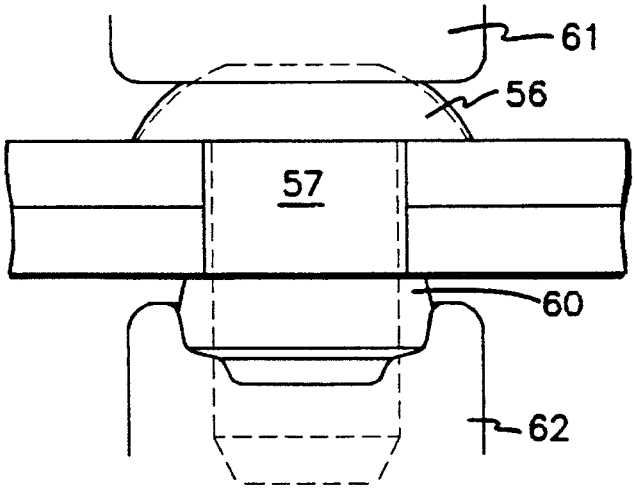

In FIG. 10 it is clearly shown that the lower rivet punch 62 has a stepped profile 70 with the parts 67,68 and 69, in which its central part 68,69 is complementary to the shape of the shank-end or the centring-edge 58 resp. of the shank 57. In this way the construction is self-centring, so that the riveting process in the manual operation can be performed very well.

In FIGS. 11–18 different phases of the riveting process are shown, from which it becomes clear that despite the hard starting material of the rivet 55—in comparison with the non-heat-treated rivet 15 from mild (AD) material or the solution heat-treated (D, S, DD or KE)-rivet from hard material in the conventional method resp. the non-heated-treated (AD) rivet from mild material in the known method—the cold deformation of the riveted head 60 from the shank-end 59 is performed in such a way that a widening out of the hole 53 occurs.

The gap 53, which initially existed (FIGS. 10 and 11), has disappeared in the later phases (FIG. 12 and following), in which notably in the end phase (FIGS. 15, 18) it can be seen that the wall 54 of the shank 57 of the rivet 55 has forced back the wall 49 of the plate-material 50, said wall bounding the hole 53, with respect to its original diameter; see the dotted line 54 in FIG. 15 indicating the original rivet-diameter, and the continuous line 49, indicating the hole-wall after widening out of the hole. In reality this is a widening of a few procents, but it is represented in the figure strongly exaggerated.

From FIGS. 9–18 the merit of the invention becomes clear, namely the fact that the shank-end, from which the upper- and/or lower head has to be formed, is surrounded by a local hollow punch, of which the inner contour is initially spaced from the (still) untreated shank-end. By this the expansion of the head to be formed is limited to 1,4 d to 1,5 d, such that no crack-formation can occur.

At the same time such great pressure forces can be exerted onto the rivet-shank without any danger (for a too great expansion of e.g. the riveted head) that the rivet shank expands radially and provides a sufficient widening out of the hole.

I claim:

1. A method of joining together metal sheets (51, 52) of a stack (50) by a rivet (55) having a shank (57), of which a shank end (59) with a beginning diameter (d) is deformed by radial expansion into a disc-shaped rivet head (60) with an ending diameter (D), said method comprising the steps of:

providing a first rivet punch (62) preliminarily with a die recess (66) having a stepped contour in a central part of the first rivet punch (62), said stepped contour comprising a bottom (60) of said die recess (66) bordered by an annular wall (68) disposed at a relatively small angle to an axis of said die recess (66) bordered in turn by an annular step (70) disposed at a relatively large angle to said axis and bordered by an annular wall (67) disposed at a relatively small angle to said axis;

positioning the first rivet punch (62) having, in the centra part (67), the profile (69) complementary to a profile of the shank end (59) so that the first rivet punch (62) stops expansion of the disc-shaped rivet head (60) before a ratio of the ending diameter (D) to the beginning diameter (d) exceeds a critical value, above which crack formation occurs;

providing initially a gap (53) between a wall (54) of the shank (57) and a wall (49) of the metal sheets (51, 52);

surrounding the shank end (59) partially with the first rivet punch (62) having an inner diameter initially spaced from the shank end (59) so that the expansion of the shank end (59) is accommodated by a hollow space in the first rivet punch (62), and also so that the ratio of the ending diameter (D) to the beginning diameter (d) remains below the critical value above which crack formation occurs; and using a second rivet punch (61) to strike a cap (56) of the rivet (55) with a force so that the shank end (59) with the beginning diameter (d) is radially deformed into the head (60) with the ending diameter (D) which matches the inner diameter of the hollow space in the first rivet punch (62);

whereby, due to expansion of the shank (57), the gap (53) disappears and a diameter of a hole, of which the gap (53) forms a part and in which the rivet (55) extends through the metal sheets (51, 52), is widened out.

2. A method according to claim 1, further comprising the step of:

forming the rivet (55) preliminarily from an aluminum alloy of high strength obtained by cooling the aluminum alloy in a hardened state.

3. A method according to claim 2, further comprising the step of:

making the aluminum alloy from an ALCOA 2000 series having one of a denomination 2017, 2017A and 2024.

4. A method according to claim 2, further comprising the step of:

making the aluminum alloy from an ALCOA 7000 series alloy with a minimum shear strength of 230 $N/mm^2$.

5. A method according to claim 4, further comprising the step of:

selecting preliminarily the ALCOA 7000 series alloy with a denomination 7050.

6. A method according to claim 1, wherein the rivet (55) is an aluminum alloy in a nonsolution heat-treated state.

7. A method according to claim 1, wherein said rivet (55) has a tapered end (58) complementary in shape to said bottom (69) and first-mentioned annular wall (68) of said die recess (66).

8. A method of joining together metal sheets (51, 52) of a stack (50) by a rivet (55) having a shank (57) and a head (60), said method comprising the steps of:

selecting an aluminum alloy having a shear strength of at least 230 $N/mm^2$ to be used in forming the rivet (55);

forming the rivet (55) in a nonsolution heat-treated state between a first punch (62) and a second punch (61), each having an internally hollow space therein, said first punch (62) having a die recess (66) having a stepped contour in a central part of the first punch (62), said stepped contour comprising a bottom (60) of said die recess (66) bordered by an annular wall (68) disposed at a relatively small angle to an axis of said die recess (66) bordered in turn by an annular step (70) disposed at a relatively large angle to said axis and bordered by an annular wall (67) disposed at a relatively small angle to said axis;

placing the punches (61, 62) initially around a shank end (59) of the rivet (55);

exerting forces on the shank (57) so as to cause the shank end (59) to expand radially;

stopping radial expansion of the shank end (59) into the head (60) in a central part (67) of the first punch (62) so that a ratio of an ending diameter (D) of the head (60) to a beginning diameter (d) of the shank end (59) remains below a critical value above which crack formation occurs; and exerting further pressure on the head (60) so that a longitudinal transport of material occurs upwardly along the shank (57);

whereby a diameter of a hole into which the rivet (55) extends through the metal sheets (51, 52) is widened out due to the expansion of the shank (57).

9. A method according to claim 8, wherein:

said radial expansion is stopped at a two-stepped contour (70) in the central part (67) of the first punch (62).

10. A method according to claim 8, wherein:

said critical value of the ratio of the ending diameter (D) of the head (60) to the beginning diameter (d) of the shank end (59), above which crack formation occurs, lies between 1.4 and 1.5.

11. A method according to claim 8, wherein said rivet (55) has a tapered end (58) complementary in shape to said bottom (69) and first-mentioned annular wall (68) of said die recess (66).

* * * * *